US007937853B2

(12) United States Patent
Kwon et al.

(10) Patent No.: US 7,937,853 B2
(45) Date of Patent: May 10, 2011

(54) FOOTWEAR FOR THE DIET EQUIPPED WITH THE BUFFERING MEANS

(75) Inventors: Si-Hyuk Kwon, Busan (KR); Seung-Kook Yang, Seongnam-si (KR)

(73) Assignee: Channel TB Co., Ltd., Seongnam-si (KR)

( * ) Notice: Subject to any disclaimer, the term of this patent is extended or adjusted under 35 U.S.C. 154(b) by 702 days.

(21) Appl. No.: 12/064,448

(22) PCT Filed: Aug. 21, 2007

(86) PCT No.: PCT/KR2007/003990

§ 371 (c)(1), (2), (4) Date: Feb. 21, 2008

(87) PCT Pub. No.: WO2008/023920

PCT Pub. Date: Feb. 28, 2008

(65) Prior Publication Data

US 2008/0216348 A1 Sep. 11, 2008

(30) Foreign Application Priority Data

Aug. 21, 2006 (KR) ..... 10-2006-0079002

(51) Int. Cl.
*A43B 13/28* (2006.01)
*A43B 3/10* (2006.01)

(52) U.S. Cl. ..... 36/27; 36/7.8; 36/35 R

(58) Field of Classification Search ..... 36/27, 28, 36/7.8, 35 R, 38

See application file for complete search history.

(56) References Cited

U.S. PATENT DOCUMENTS

| | | | | | |
|---|---|---|---|---|---|
| 1,566,513 | A * | 12/1925 | Thackery | 36/7.8 |
| 1,858,833 | A * | 5/1932 | Leach | 36/7.8 |
| 2,475,092 | A * | 7/1949 | Harrell | 36/7.8 |
| 2,669,038 | A * | 2/1954 | De Werth | 36/38 |
| 4,196,903 | A * | 4/1980 | Illustrato | 482/77 |
| 4,322,893 | A * | 4/1982 | Halvorsen | 36/43 |
| 4,457,084 | A * | 7/1984 | Horibata et al. | 36/7.8 |
| 5,343,637 | A | 9/1994 | Schindler | |
| 5,752,329 | A * | 5/1998 | Horibata | 36/27 |
| 6,751,891 | B2 * | 6/2004 | Lombardino | 36/28 |
| 2004/0154191 | A1 * | 8/2004 | Park | 36/28 |

FOREIGN PATENT DOCUMENTS

| | | |
|---|---|---|
| KR | 20-0164049 Y1 | 2/2000 |
| KR | 20-0185119 Y1 | 6/2000 |
| KR | 20-0381741 Y1 | 4/2005 |

* cited by examiner

*Primary Examiner* — Marie Patterson
(74) *Attorney, Agent, or Firm* — Birch, Stewart, Kolasch & Birch, LLP

(57) ABSTRACT

The present invention relates to a health and diet footwear with buffering means that has a plurality of spring members mounted on the lower portion thereof, thereby obtaining substantially higher exercising effects as compared to a general footwear. The health and diet footwear with buffering means of the invention can detachably mount fixed plates on a sole by means of screws and have a plurality of spring members disposed between the fixed plates disposed on the upper ends of the spring members and a support plate disposed on the lower ends of the spring members by means of detachable mounting or spiral coupling, so that the spring members can be easily and rigidly coupled therebetween. Further, when a part of the spring members is damaged or broken, it can be exchanged individually. Therefore, this invention can couple the fixed plates and the support plate in a more rigid and easier manner when compared with the conventional practice, which allows a wearer to wear the footwear of this invention more stably for a long time.

2 Claims, 4 Drawing Sheets

[Fig. 1]
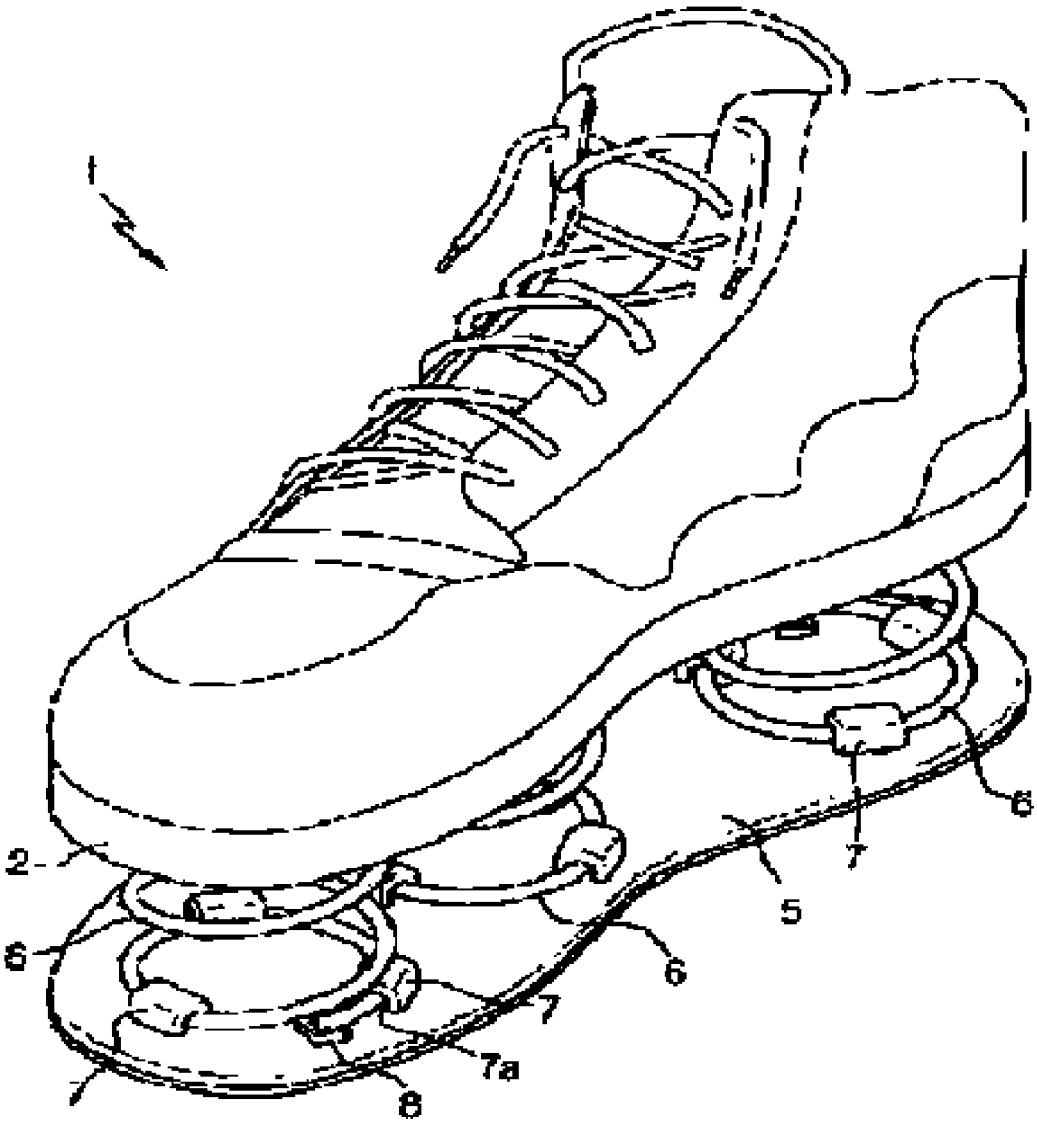

[Fig. 2]
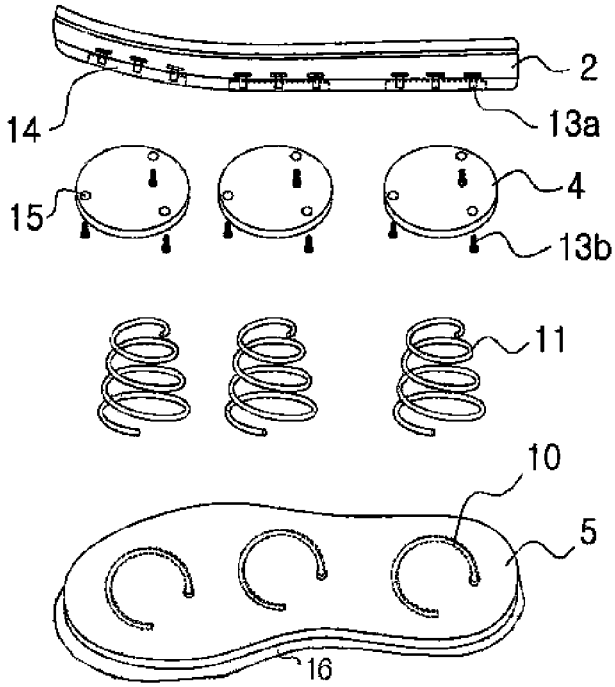
[Fig. 3]
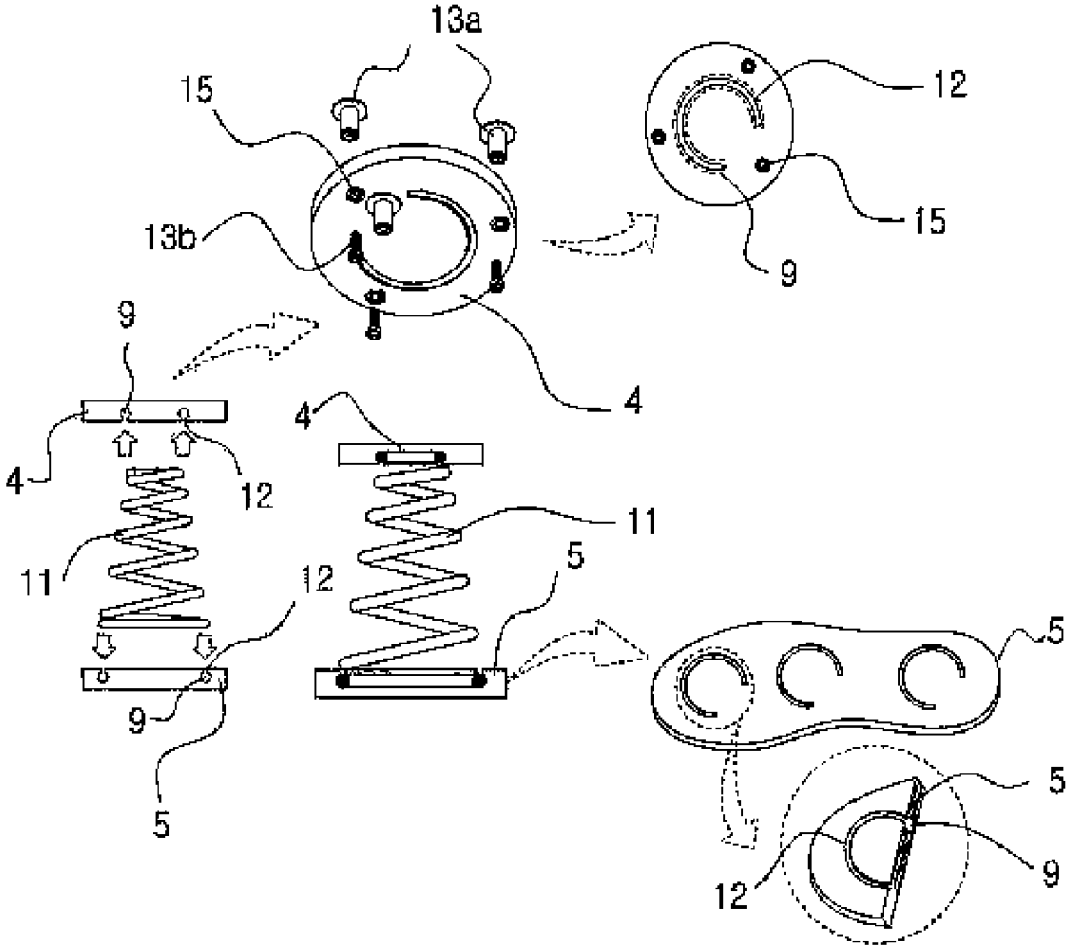

[Fig. 4]
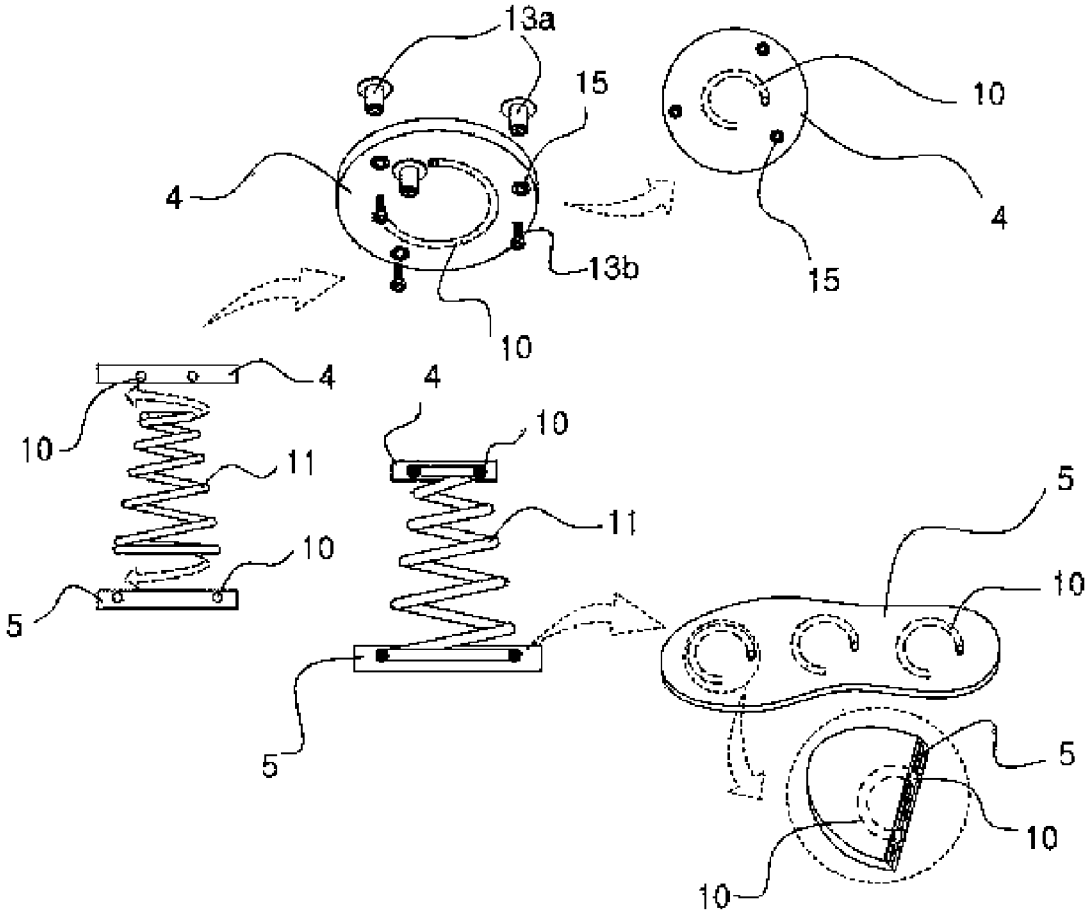

[Fig. 5]
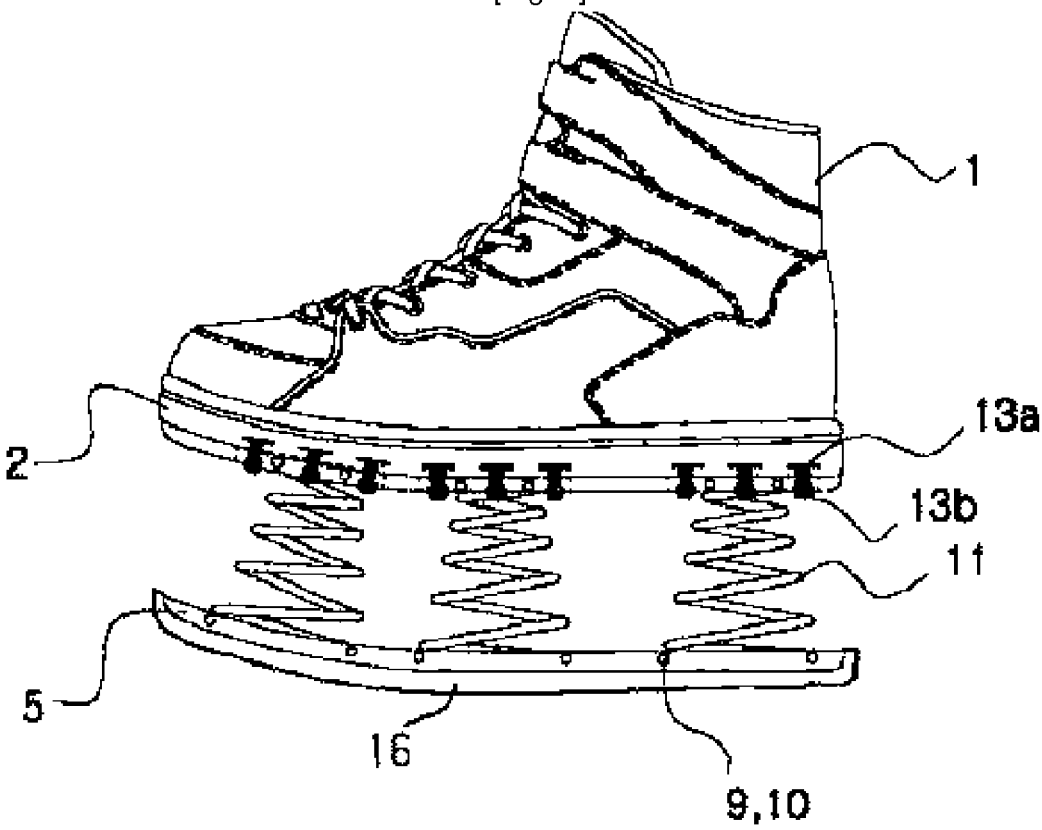

FOOTWEAR FOR THE DIET EQUIPPED WITH THE BUFFERING MEANS

TECHNICAL FIELD

The present invention relates to a health and diet footwear with buffering means that has a plurality of spring members mounted on the lower portion thereof, thereby obtaining substantially higher exercising effects as compared to a general footwear.

BACKGROUND ART

Generally, a spring footwear that is representative one of a footwear with buffering means is made by incorporating a plurality of spring members into the bottom portion thereof, so that as the elastic forces are generated from the plurality of spring members, jumping effects are provided to a wearer. Thus, the spring footwear gives much pleasure to the wearer like children. On the other hand, the spring footwear provides substantially higher exercising effects as compared to a general footwear, if a wearer who has the two kinds of footwear takes the same motions during the same time period. Thus, the spring footwear is widely used among the adults having insufficient exercise time, for improving their health and diet effects.

However, the conventional spring footwear has had several problems during the practical use, and more particularly, some disadvantages found in the conventional spring footwear as disclosed in Korean Utility Model Registration No. 20-0381741 are explained below.

FIG. 1 shows the prior art spring footwear as disclosed in Korean Utility Model Registration No. 20-0381741, wherein at least two or more cylindrical spring members 6 are disposed between two or more fixed plates 4 fixed to a sole 2 by means of a rivet 3 and a support plate 5 abutting against the ground, and three tunnel type fixing members 7 having fitting holes 7*a* formed in a circumferential direction thereof are protrudedly formed on each of the fixed plates 4 and the support plate 5, so that the steel wire of each of the spring members 6 is fixedly fit into the fitting holes 7*a*, and a retaining protrusion 8 is formed at the outside of one side fixing member 7, for supporting the end portion of the steel wire of each of the cylindrical spring members 6 fit into the fitting holes 7*a*.

According to the conventional spring footwear 1 under the above configuration, the fixed plates 4 fastened on the top ends of the cylindrical spring members 6 are fixed to the sole 2 by means of the rivets 3. Once fixed, however, the fixed plates 4 cannot be separated from the sole 2, and thus, if a portion of the plurality of cylindrical spring members 6 is damaged or broken while in use, it cannot be exchanged with new one, so that unfortunately, the entire footwear should be useless.

Further, the fixed plates 4 coupled on the bottom surface of the sole 2 and the fixing members 7 disposed on the support plate 5 on which the lower ends of the cylindrical spring members 6 are coupled are protrudedly formed, such that whenever the spring members 6 are expanded and contracted, the steel wires apply compression to the protruded fixing members 7, thereby undesirably causing the tunnel type fixing members 7 to be abraded or even damaged.

As shown in FIG. 1, additionally, each of the spring members 6 is formed in a cylindrical shape, and therefore, the upper and lower steel wires of each spring member 6 frictionally collide against each other upon the expansion and contraction of the spring member 6, thereby undesirably causing the generation of noises therefrom.

DISCLOSURE OF INVENTION

Technical Problem

Accordingly, the present invention has been made in an effort to solve the above problems, and it is an object of the present invention to provide a health and diet footwear with buffering means that can detachably mount fixed plates on a sole by means of screws, that can have a plurality of spring members disposed between the fixed plates disposed on the upper ends of the spring members and a support plate disposed on the lower ends of the spring members by means of detachable mounting or spiral coupling, so that the spring members can be easily and rigidly coupled therebetween, and that can prevent the generation of noises caused by the collision of steel wires spaced apart from each other at equal intervals in the conventional cylindrical spring members, as each of the spring members is formed in a conical shape diametrically enlarged toward the lower end portion thereof.

It is another object of the present invention to provide a health and diet footwear with buffering means that has a plurality of spring members more enlarged at the lower end portion thereof as compared to a conventional spring footwear, thereby providing stable wearing feeling to a wearer.

Technical Solution

To achieve the above objects, according to the present invention, there is provided a health and diet footwear with buffering means that has at least two or more cylindrical spring members disposed between two or more fixed plates fixed to a sole and a support plate shaped like an outsole abutting against the ground, such that the coupling parts of the upper and lower end portions of a spring member are embedded into the bottom surface of the sole and the top surface of the support plate, wherein the sole has a plurality of fixed plate-attaching recesses formed on the bottom surface thereof, each of the fixed plate-attaching recesses having a diameter and a thickness corresponding to those of the fixed plates and a plurality of female screws formed on the bottom surface thereof, each of the fixed plates having a plurality of screw through-holes formed thereon correspondingly to the female screws, such that after each of the fixed plates is inserted into the corresponding fixed plate-attaching recess, the male screws are coupled to the female screws, thereby detachably mounting the fixed plates onto the sole, and wherein each of the coupling parts of the upper and lower end portions of the spring member has an insertion groove formed on each of the fixed plates and the support plate, the insertion groove having a diameter and a shape corresponding to a sectional diameter and an arc shape of the steel wire of the end portion of each of the spring members and having an opening portion formed therealong, the opening portion having a smaller diameter than the sectional diameter of the steel wire of the end portion of each of the spring members, such that the steel wires of the upper and lower end portions of each of the spring members are compressively inserted into the opening portions of each of the fixed plates and the support plate so as to be coupled rigidly to the insertion grooves thereof.

According to the present invention, preferably, the spring member upper end-coupling part and the spring member lower end-coupling part have a spiral tunnel hole formed inside each of the fixed plates and the support plate, respectively.

ADVANTAGEOUS EFFECTS

The present invention relates to a health and diet footwear with buffering means that has a plurality of spring members detachably mounted on the lower portion thereof, such that if each of the spring members is damaged or abraded, a portion of the spring members can be easily exchanged with new one, thereby providing economical savings and stable wearing feeling to a wearer, and further, each of the spring members is of a conical shape, thereby preventing the generation of noises therefrom and stably supporting the wearer's weight.

BRIEF DESCRIPTION OF THE DRAWINGS

FIG. 1 is a perspective view showing a conventional spring footwear;

FIG. 2 is an exploded perspective view showing a health and diet footwear with buffering means according to the present invention;

FIG. 3 is a partly enlarged view showing a coupling part with an insertion groove in the health and diet footwear according to the present invention;

FIG. 4 is a partly enlarged view showing a coupling part with a spiral tunnel hole in the health and diet footwear according to the present invention; and FIG. 5 is a side view showing the assembled state of the health and diet footwear according to the present invention.

BEST MODE FOR CARRYING OUT THE INVENTION

Hereinafter, an explanation of the health and diet footwear according to the present invention will be given with reference to attaching drawings. FIG. 2 is an exploded perspective view showing a health and diet footwear with buffering means according to the present invention, FIG. 3 is a partly enlarged view showing a coupling part with an insertion groove in the health and diet footwear according to the present invention, FIG. 4 is a partly enlarged view showing a coupling part with a spiral tunnel hole in the health and diet footwear according to the present invention, and FIG. 5 is a side view showing the assembled state of the health and diet footwear according to the present invention.

The present invention suggests the health and diet footwear that can achieve the spring-coupling in rigid and easy manners and detachably mount fixed plates 5 on a sole 2 by means of fixing means like screws 13*a* and 13*b* in an easy manner. The preferred embodiments of the present invention will be discussed below.

First Embodiment

The coupling structure of the spring member 11 is very important in the health and diet footwear 1, and according to the teachings of the present invention, the spring members 11 can be detachably mounted individually in rigid and easy manners. In more detail, a plurality of spring members 11 are erected and coupled between the sole 2 and the support plate 5, as mentioned in the prior art, for elastically supporting a wearer's weight.

As mentioned above, the object of the present invention is to provide the coupling structure of the spring members wherein the spring members 11 can be detachably mounted individually in more rigid and easier manners as compared to the prior art spring footwear. Thus, an insertion groove 9 is formed with no protrusion on each of the fixed plates 4 to which the upper end portion of each of the spring members 11 is coupled and on the support plate 5 to which the lower end portion of each spring member 11 is coupled, having a size corresponding to the lengths of the steel wires of the upper and lower portions of each spring member 11. Further, the insertion groove 9 has an opening portion 12 formed along the top end circumference thereof in a direction to which the steel wire of each of the spring members 11 is insertedly fit, the opening portion 12 having a smaller diameter than a sectional diameter of the steel wire of each of the spring members 11. If the end of the steel wire of each of the spring members 11 is pressedly inserted into the insertion groove 9, it can be easily coupled to each of the fixed plates 4 and the support plate 5.

The insertion groove 9 into which the end portion of each spring member 11 is inserted has the opening portion 12 having a smaller diameter than a sectional diameter of the steel wire of each of the spring members 11 in the direction to which the steel wire of each of the spring members 11 is insertedly fit, as shown in FIG. 3, and thus, if the end of the steel wire of each of the spring members 11 is forcedly compressively inserted into the insertion groove 9, the opening portion 12 becomes opened and the steel wire is easily inserted into the insertion groove 9, thereby achieving the coupling structure between each of the fixed plates 4 and the support plate 5 in a very simple manner.

Also, since the entire end portion of the steel wire of each of the spring members 11 is inserted into the insertion groove 9, the spring member 11 can be more rigidly coupled as compared with that partly fixed by the three tunnel type fixing members 7 in the conventional spring footwear.

Further, the insertion groove 9 is formed inside the fixed plate 4 and the support plate 5, thereby completely overcoming the conventional problem that whenever the spring members 6 are expanded and contracted, they apply compression and friction to the fixing members 7, thereby undesirably causing the tunnel type fixing members 7 to be abraded or even damaged.

Second Embodiment

In addition to the coupling structure of the insertion groove 9 wherein the steel wire of the spring member 11 is detachably mounted as mentioned above, another embodiment of the present invention will be suggested herein. Also, the second embodiment of the present invention is aimed to solve the conventional problem that the protruded fixing members 7 are abraded and damaged, and according to the second embodiment of the present invention, a spiral tunnel hole 10 is formed inside the fixed plate 4 to which the upper end portion of each of the spring members 11 is coupled and on the support plate 5 to which the lower end portion of each of the spring members 11 is coupled.

In more detail, the spring member 11 is of a generally spiral shape such that the upper portions are spaced apart from the lower portions at given intervals. Thus, the spiral tunnel hole 10 is formed to a shape corresponding to the spiral spring member 11 on the fixed plate 4 and the support plate 5, and an entrance portion is formed on the surfaces of the fixed plate 4 and the support plate 5 along the spiral tunnel hole 10, for fittedly inserting the end portion of the steel wire of each of the spring members 11.

Under the above configuration, the end portion of the steel wire of each of the spring members 11 is inserted into the entrance portion of the spiral tunnel hole 10 and is then fittedly coupled along the spiral tunnel hole 10. The coupling structure is more rigid as compared to the conventional coupling structure. In this case, the coupling structure is formed inside the fixed plate 4 and the support plate 5, with no protrusion therefrom, thereby structurally solving the conventional problem that the protruded fixing members 7 are abraded and damaged by the compression and friction of the steel wire of the spring member 6 against the fixing member 7.

Third Embodiment

The present invention also proposes the coupling structure of the fixed plate 4 fixed to the sole 2, but in the conventional practice, the fixed plate 4 is fixed by means of the rivets 3 on the sole 2. Once fixed, thus, if a portion of the spring members 6 is damaged or broken while in use, it cannot be exchanged with new one.

According to the present invention, so as to solve this problem, the fixed plate 4 is fixed by means of a screw part 13 including female screws 13*a* and male screws 13*b* detachably mounted on the sole 2, and thus, if the spring member 11 is to be exchanged after damaged, the corresponding female and male screws 13*a* and 13*b* are unfastened and individually exchanged with new one.

First of all, referring in detail to the fixing structure of the fixed plate 4 to the sole 2, a plurality of fixed plate-attaching recesses 14 are formed on the bottom surface of the sole 2, each of the fixed plate-attaching recesses 14 has a diameter and a thickness corresponding to those of fixed plates 4. Then, the fixed plate 4 is attachably coupled to the fixed plate-attaching recess 14 by means of the screw part 13, such that the sole 2 becomes flat, without having any depression or prominence formed on the surface thereof.

In the coupling structure of the fixed plate 4 under the above configuration according to the present invention, the screw part 13 including the female screws 13*a* and the male screws 13*b* is adopted such that the fixed plate 4 can be detachably mounted on the sole 2 with ease. In more detail, as shown in FIGS. 3 and 4, the female screws 13*a* are formed on the fixed plate-attaching recess 14 as a unitary body with the sole 2, and they are spaced apart from one another at given intervals along the edge periphery of the fixed plate-attaching recess 14. Thus, the fixed plate 4 is disposed on the fixed plate-attaching recess 14, and the male screws 13*b* are fastened, such that the fixed plate 4 is insertedly coupled correspondingly to the fixed plate-attaching recess 14 of the sole 2. In this case, the fixed plate 4 has a plurality of screw through-holes 15 formed at the positions thereof corresponding to the female screws 13*a*, each of the screw through-holes 15 having the male screw 13*b* passed therethrough. Contrarily, if the spring member 11 is to be exchanged with new one, the male screws 13*b* are just unfastened, thereby finishing the exchanging with ease. Therefore, the male screw 13*b* is preferably formed of a screw having a hexagonal top portion.

Fourth Embodiment

In the conventional practice, the cylindrical spring member 6 has the steel wires spaced apart from one another at equal intervals. When the cylindrical spring member 6 is contracted by a wearer's weight upon his or her walking or running, the upper and lower steel wires collide against each other. Thereby, noises are generated such that the wearer cannot concentrate on his or her exercise. So as to solve these problems, therefore, each of the spring members according to the present invention is formed in a conical shape diametrically enlarged toward the lower end portion thereof, thereby preventing the generation of noises therefrom, and it is also coupled at the enlarged lower end portion thereof with the support plate 5, thereby stably supporting the wearer's weight.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The present invention relates to a health and diet footwear with buffering means that has a plurality of spring members detachably mounted on the lower portion thereof such that if each of the spring members is abraded or damaged, a portion of the spring members can be easily exchanged with new one, thereby providing economical savings and stable wearing feeling to a wearer.

The invention claimed is:

1. A health and diet footwear with buffering means that has at least two or more cylindrical spring members disposed between two or more fixed plates fixed to a sole and a support plate shaped like an outsole abutting against the ground, such that the coupling parts of the upper and lower end portions of a spring member are embedded into the bottom surface of the sole and the top surface of the support plate, wherein the sole has a plurality of fixed plate-attaching recesses formed on the bottom surface thereof, each of the fixed plate-attaching recesses having a diameter and a thickness corresponding to those of the fixed plates and a plurality of female screws formed on the bottom surface thereof, each of the fixed plates having a plurality of screw through-holes formed thereon correspondingly to the female screws, such that after each of the fixed plates is inserted into the corresponding fixed plate-attaching recess, the male screws are coupled to the female screws, thereby detachably mounting the fixed plates onto the sole, and wherein each of the coupling parts of the upper and lower end portions of the spring member has an insertion groove formed on each of the fixed plates, the insertion groove having a diameter and a shape corresponding to a sectional diameter and an arc shape of the steel wire of the upper end portion of each of the spring members and having an opening portion formed therealong, the opening portion having a smaller diameter than the sectional diameter of the steel wire of the upper end portion of each of the spring members, and has an insertion groove formed on the support plate, the insertion groove having a diameter and a shape corresponding to a sectional diameter and an arc shape of the steel wire of the lower end portion of each of the spring members and having an opening portion formed therealong, the opening portion having a smaller diameter than the sectional diameter of the steel wire of the lower end portion of each of the spring members, such that the steel wires of the upper and lower end portions of each of the spring members are compressively inserted into the opening portions of each of the fixed plates and the support plate so as to be coupled rigidly to the insertion grooves thereof.

2. The health and diet footwear with buffering means according to claim 1, wherein the coupling parts of the upper and lower end portions of the spring member have a spiral tunnel hole formed inside each of the fixed plates and the support plate, respectively.

* * * * *